US006278111B1

(12) United States Patent
Sheehan et al.

(10) Patent No.: US 6,278,111 B1
(45) Date of Patent: Aug. 21, 2001

(54) ELECTROSPRAY FOR CHEMICAL ANALYSIS

(75) Inventors: Edward W. Sheehan; Ross C. Willoughby, both of Pittsburgh, PA (US); Joseph A. Jarrell, Newton Highlands; David M. Strand, Sherborn, both of MA (US)

(73) Assignee: Waters Investments Limited

( * ) Notice: Subject to any disclaimer, the term of this patent is extended or adjusted under 35 U.S.C. 154(b) by 0 days.

(21) Appl. No.: 09/191,866

(22) Filed: Nov. 12, 1998

Related U.S. Application Data

(63) Continuation-in-part of application No. 08/790,568, filed on Jan. 29, 1997, now abandoned, and a continuation-in-part of application No. 08/701,050, filed on Aug. 21, 1996, now Pat. No. 5,838,002.

(60) Provisional application No. 60/002,602, filed on Aug. 21, 1995.

(51) Int. Cl.[7] ..... H01J 49/10

(52) U.S. Cl. ..... 250/288; 250/281

(58) Field of Search ..... 250/288, 423 R, 250/281, 282

(56) References Cited

U.S. PATENT DOCUMENTS

| | | |
|---|---|---|
| 1,246,709 | 11/1917 | Hazelby et al. . |
| 4,023,398 | 5/1977 | French et al. . |
| 4,160,161 | 7/1979 | Horton . |

(List continued on next page.)

OTHER PUBLICATIONS

J. Sunner et al, .Factors Determining Relative Sensitivity of Analytes in Positive Mode Atmosphere Pressure Ionization Mass Spectometry, Anal. Chem, vol. 80, pp. 1300–1307, 1988.

J. Henion, et al, Determination of Sulfa Drugs in Biological Fluids by Liquid Chromatography/Mass Spectrometry/Mass Spectrometry, Anal Chem, vol. 54, pp. 451–458, 1982.

Smith, et al, Improved Electrospray Ionization Interface for Capillary Zone Electrophoresis–Mass Spectrometry, Anal. Chem, vol., 60, pp. 1948–1952, 1988.

M. Mann, Electrospray: Its Potential and Limitations as an Ionization Method for Biomolecules, Organic Mass Spectrometry, vol. 25, pp. 575–587, 1990.

Ikonomou, et al, Investigations of the Electrospray Interface for Liquid Chromatography/Mass Spectrometry, Anal Chem 1990, 62, pp. 957–967.

Zolotok, et al, Mass Spectography Of The Field Evaporation of Ions from Liquid Solutions in Glycerol, Plenum Publishing Corporation, pp. 937–942, 1981.

B. Simpson, Mass Spectrometry of Solvated Ions Generated Directly from the Liquid Phase by Electrohydynamic Ionization, of Physical Chemistry, vol. 82, No. 6, 1978.

Mark et al, Open Tubular liquid Chromatography: Studies in Column efficiency and detection, University of North Carolina, Chapel Hill, N.C. 1991.

(List continued on next page.)

*Primary Examiner*—Kiet T. Nguyen
(74) *Attorney, Agent, or Firm*—John L. Lee; Anthony J. Janiuk

(57) ABSTRACT

An improved electrospray (ES) apparatus has a low pressure ES chamber coupled to a desolvation chamber. The desolvation chamber desolvates the incoming analyte ions of the cone-jet with non-conductive energy. The apparatus stabilizes cone-jet formation in the ES chamber. The apparatus receives solvated ions without pressure reduction, produces desolvated ions with non-conductive energy in a low pressure region, and outputs the desolvated ions towards a mass spectrometer as a substantially solvent-free ion beam suitable for mass spectrometer analysis. The apparatus avoids the degree of pressure reduction featured in prior ES techniques.

21 Claims, 9 Drawing Sheets

U.S. PATENT DOCUMENTS

| | | | | |
|---|---|---|---|---|
| 4,209,696 | | 6/1980 | Fite . | |
| 4,531,056 | | 7/1985 | Labrowsky et al. . | |
| 4,542,293 | | 9/1985 | Fenn et al. . | |
| 4,607,163 | | 8/1986 | Mizuno . | |
| 4,842,701 | | 6/1989 | Smith et al. . | |
| 4,861,988 | | 8/1989 | Henion et al. . | |
| 4,885,076 | | 12/1989 | Smith et al. . | |
| 4,935,624 | | 6/1990 | Henion et al. . | |
| 4,977,320 | | 12/1990 | Chowdhury et al. . | |
| 4,977,785 | | 12/1990 | Willoughby et al. . | |
| 4,999,493 | | 3/1991 | Allen et al. . | |
| 5,015,845 | | 5/1991 | Allen et al. . | |
| 5,115,131 | | 5/1992 | Jorgenson et al. . | |
| 5,162,650 | | 11/1992 | Bier . | |
| 5,245,186 | | 9/1993 | Chait et al. . | |
| 5,306,412 | | 4/1994 | Whitehouse et al. . | |
| 5,349,186 | | 9/1994 | Ikonomou et al. . | |
| 5,393,975 | | 2/1995 | Hail et al. . | |
| 5,581,081 | | 12/1996 | Kato et al. . | |
| 5,753,910 | * | 5/1998 | Gourley et al. | 250/288 |
| 5,838,002 | * | 11/1998 | Sheehan | 250/288 |

OTHER PUBLICATIONS

Willoughby et al, Studies of the Physical Processes of Electrospray Presented in the 4$^{th}$ International Aerosol Conference, Los Angeles, CA Aug. 29–Sep. 2, 1994.

Luttgens et al, Field Inducted disintegration of glycerol solutions under vacuum and atmosphere pressure conditions studied by optical microscopy and mass spectrometry, Surface Science, 266 (1992) pp. 197–203.

Lee et al, An EHD Source for the Mass Spectral Analysis of Peptides, Presented at the 36$^{th}$ ASMS Conference on Mass Spectrometry and Allied Topics, Jun. 5–10, 1988, San Francisco, CA.

Mahoney et al, Electrohydrodynamic Ion Source Design for Mass Spectrometry: Ionization, Ion Optics and Desolvaiton, Presented at the 38$^{th}$ ASMS Conf. on Mass Spectrometry and Allied Topics.

Grace et al, A Review of Liquid Atomization by Electrical Means, J. Aerosol Sci., vol. 25, No. 6, pp. 1005–1019, 1994.

Dulcks et al, Ion Source for Electrohydrodynamic Mass Spectrometry, Journal of Mass Spectrometry, vol. 30, 324–332, (1995).

Cook et al, Electrohydrodynamic mass spectrometry, Mass Spectrometry Reviews 1986, 5, 467–519.

* cited by examiner

ELECTROSPRAY FOR CHEMICAL ANALYSIS

This application is a continuation-in-part of application Ser. No. 08/701,050, filed Aug. 21, 1996 now U.S. Pat. No. 5,838,002; and Ser. No. 08/790,568, filed Jan. 29, 1997 (now abandoned, with Ser. No, 08/701,050). This application also claims the benefit of provisional application Ser. No. 60/002602, filed Aug. 21, 1995.

STATEMENT REGARDING FEDERALLY FUNDED RESEARCH

This invention was made with United States Government support under Grant No. 1 R43 GM54492-01 from the National Institutes of Health. The U.S. Government may have certain rights to this invention.

FIELD OF THE INVENTION

The present invention relates to a method and apparatus for electrospraying solutions of chemical species for detection in gas phase ion detectors from liquid solutions. One embodiment provides a method and apparatus for producing ions suitable for analysis in a mass spectrometer. More particularly, the invention relates to electrospray ionization techniques for stabilizing and receiving a cone-jet, producing desolvated ions, and outputting the ions to a liquid chromatography mass spectrometer.

BACKGROUND OF THE INVENTION

Mass spectrometry (MS) is an accepted analytical technique for determining the molecular weight and chemical structure of an analyte of interest. Generally, a determination is made by ionizing an analyte, and analyzing the movement of the ions with respect to predetermined electric and/or magnetic fields in a mass spectrometer. Prior methods of producing the analyte ions such as electron impact ionization, chemical ionization, and photo-ionization are typically useful only for molecules with a molecular weight of about a few hundred daltons or less.

The production of intact gas phase ions from compounds dissolved in solution has been a topic of considerable attention for some time, particularly in liquid chromatography-mass spectrometry.[1] Typically, the ion production process has been problematic for labile and/or high molecular weight compounds because, in many cases, the energy input to facilitate a phase change from liquid to the gas resulted in chemical reactions, rearrangements or degradation of the analyte of interest. Many compounds separated with liquid chromatography fall into this category. In recent years electrospray (ES) and electrohydrodynamic processes (EHD) have successfully demonstrated capabilities for ion production with both labile and high molecular weight compounds.[2-6] The terms electrospray and electrohydrodynamic are sometimes used interchangeably. For the present discussion we will refer to both processes as electrospray and restrict our definition to sprays in which conical deformation of the liquid occurs as a result of high electrical potential. This is referred to as the cone-jet mode of electrospray.

In general, ES involves introducing an analyte into a capillary tube attached to an open-ended needle (e.g., a small bore syringe needle) within an ES chamber. The analyte can be introduced by pumping or electro-osmotic flow. When the needle is electrically charged, the analyte is released as a fine spray of highly charged droplets (i.e. a cone-jet) that is generally desolvated to produce an ion beam suitable for MS.

The mechanism of ion production in ES has been the subject of considerable debate over the years.[7] The characteristic geometry of ES aerosol and ion generators is the simple cone-jet[8] as seen in FIG. 1. We can summarize the process of electrospray by describing each part of the spray as labeled. A conducting liquid usually emerges from a capillary tube held at high electrical potential (Region A). The liquid accelerates toward a counterelectrode and assumes the characteristic conical geometry (Region B). At the apex of the cone, a high velocity jet emerges (Region C) which subsequently breaks into highly charged droplets (Region D). The highly charged droplets in Region D are generally evaporated with dry gas[5] or heat[9] to produce further breakup of the liquid and formation of gas phase ionic species. In some instances ions are emitted directly from the apex of the cone instead of a jet, particularly with liquid metal emittors.[10] Cone-jet aerosol sources have been utilized for a number of applications; including, mass spectrometry sample introduction and ionization,[5,11] particle generation,[12] and thruster technology,[13] and liquid metal ion sources.[10] The operation of cone-jet source of aerosols has been demonstrated at atmospheric[14-17] and at reduced pressure.[10,18]

The production of ions from an ES source has demonstrated extremely good applicability for compounds that are labile and/or high molecular weight. ES is suitable for interfacing with analytical separation techniques such as liquid chromatography (LC), e.g., high performance liquid chromatography (HPLC); and capillary zone electrophoresis (CZE)[26]. Typically ES ion sources are operated at atmospheric pressure because of the efficient heat transfer at these pressures to the charged droplets which results in the evaporation of the primary droplets and concomitantly causes efficient ion production. Unfortunately, at atmospheric pressure only a fraction of the ions produced are actually sampled into the low pressure detectors because of the difficulty of focusing and sampling ions through small sampling apertures to reduced pressures. Larger apertures are sometimes used to improve sampling efficiencies; however, these require more costly and/or higher capacity pumping on the vacuum system to maintain acceptable detector operating pressures. Another limitation of atmospheric pressure ES operation is the threshold of electrical discharge across the gap between the high electrical potential capillary and the counterelectrode. This threshold is generally a function of capillary and counterelectrode spacing and geometry, surrounding gas composition, and pressure. The operating voltages are limited by the discharge threshold due to partial or complete degradation of the electrospray process during an electrical discharge. Discharges generally present a greater limitation while operating atmospheric pressure ES sources in the negative ion mode.[19,20]

The operation of ES processes at reduced pressures has allowed scientists to reduce the total gas load on the vacuum system. The operating pressure must be sufficiently low to prevent electrical discharge.[21] Experimental results with ES at low pressure have demonstrated (1) instability of the liquid cone-jet resulting in the formation of multiple swirling cone-jets; (2) instability in the directionality of the resulting liquid jet; (3) freezing and (4) boiling of the liquid cone at the end of the capillary; (5) a high degree of solvent clustering of the ions leaving the electrospray cone; and (6) gas phase ions possessing a wide spread in kinetic energy making the collection and focusing of the ions difficult.[2-4,6,18,21] Solvent clustering, along with the divergence of the droplets from the axis of the tip of the liquid cone, freezing and boiling of the liquid cone and instability of the electrospray cone have made ion detection in the low pressure mode of operation irreproducible and difficult to interpret.

Practitioners of EHD minimize the problem of freezing and boiling by dissolving their analyte in a non-volatile solvent, such as glycerine, and introducing the sample into a vacuum chamber at reduced flow rates (nanoliters/min). Some low pressure ES devices included various lenses for controlling the ions (not droplets) downstream from ES needle.[3,46,18] Prior related art can be divided into four (4) groups:

1. low pressure electrospray without a focusing means for sampling into a low pressure detector (such as, references 4 and 23);
2. low pressure electrospray with a focusing means for directing the aerosol into low pressure detectors (such as, references 3 and 6);
3. low pressure electrospray with a focusing means for directing aerosol into a high pressure declustering region (such as, reference 6); and
4. low pressure electrospray without a focusing means and sampling the aerosol into a high pressure ionization region (such as, reference 22).

The art of Mahoney and coworkers[6] addresses declustering downstream from the spray but does not effectively deal with the evaporation of droplets produced at low pressure.

Platzer[22] addresses the problem of solvent declustering and wide kinetic energy spread at low pressures by directly spraying from low pressures through a heated tube into a higher pressure ionization region. The art of Platzer fails to address the inherent instability of the primary electrospray process, freezing and boiling in a vacuum; and the wide angular and spatial dispersion of the spray. The primary outcome of failing to address the low pressure spray stability will result in significant losses of analyte and droplets on the walls of their first chamber and the heated transfer tube. Although, they may collect some of the spray through the tube by virtue of large cross sectional diameters, they will still have an irreproducible and unstable signal resulting from the unstable spray processes.

However, significant disadvantages are encountered when ES is used to make a cone-jet at or near atmospheric pressure. For example, the analyte ions of the cone-jet are often exposed to pressure reduction as the ions are desolvated. Transport of the analyte ions usually occurs with a high gas load interfacing system which, even when working optimally, causes a substantial loss in signal strength, sometimes at a level of about four orders of magnitude. Large sampling apertures are sometimes used to improve sampling efficiencies; however these apertures require more costly and/or higher capacity vacuum pumping systems to maintain acceptable mass spectrometer operating pressures.

Another limitation of atmospheric pressure ES is the presence of an electrical discharge threshold across a gap between the needle and a counterelectrode. An electrical discharge typically causes degradation of the cone-jet in the ES chamber. The electrical discharge threshold limits ES operating voltages at atmospheric pressure, and it is affected by the spacing and geometry of the needle and counterelectrode, as well as the composition and pressure of the surrounding gas[2]. Electrical discharges present even greater limitations if the highly charged droplets are made in the negative ion mode[20]. Further, such discharges can adversely limit the choice of gas to be used in the ES chamber[27].

The disadvantages inherent in atmospheric mode ES are relevant when ES is interfaced with LC/MS, or CZE/MS systems such as disclosed in U.S. Pat. Nos. 4,842,701 and 4,885,076 to Smith et al.

Another ES mode of operation involves producing the cone-jet in an evacuated ES chamber. For example, U.K. Patent No. 1,246,709 to Hazelby and Preston discloses spraying charged droplets into an evacuated ES chamber and then heating the droplets with an optical source. A related method has been disclosed in U.S. Pat. No. 4,160,161 to Horton.

However, significant disadvantages are encountered when a cone-jet is made in an evacuated chamber. For example, the chance of electrical discharges and distortions is increased, in part because the cone-jet can make contact with the ES chamber wall. Additionally, making the cone-jet in an evacuated chamber can often result in undesirable solvent clustering[3&4]. Also, disadvantageously, aerosol pulsations, freezing, boiling, non-reproducible MS spectra, ion clusters, and wide ion distributions can result.

Cone-jets produced by most prior ES techniques include solvated analyte ions, making them unsuitable for MS. Desolvation of the analyte ions has been achieved by a variety of methods. For example, one ES mode of operation uses heated gases, capillaries and the like to cause desolvation at or near atmospheric pressure (U.S. Pat. Nos. 5,105,845 to Allen and Vestal; 4,531,056 to Labowsky et al.; and 4,977,320 to Chowdhury et al.), whereas another ES mode uses solvent-depleted gas for desolvation (i.e. "countercurrent" gas method, see U.S. Pat. No. 4,209,696 to Fite). Other methods use pressure reduction and heat to remove solvent (U.S. Pat. No. 5,105,845 to Allen and Vestal; U.S. Pat. No. 5,105,845 to Horton), while still other methods desolvate analyte ions by combining pressure reduction and a flow of heated gas (U.S. Pat. No. 4,531,056 to Labowsky et al.; U.K. Patent No. 1,246,709 to Hazelby and Preston). However, such methods generally cause high gas loads, resulting in low efficiency ion transfer to the mass spectrometer.

Additionally, the use of a countercurrent gas at or near atmospheric pressure (e.g., see U.S. Pat. No. 4,209,696 to Fite) increases the complexity of analysis. For example, gas flow rate and temperature must often be optimized for each analyte and solvent of interest, making the technique time-consuming when multiple analytes and solvents are used.

The object of the current invention is to overcome the aforementioned limitations of both atmospheric pressure and low pressure operations of electrospray.

BACKGROUND ART REFERENCE

1. Neissen, W. M. A.; van der Greef, J. Liquid chromatography-Mass Spectrometry, Principles and Applications, Dekker: New York, 1992.
2. Smith, D. P. H. IEEE Trans. Ind. Appl. 1986, IA-22, 527–535. *The electrohydrodynamic atomization of liquids.*
3. Cook, K. D. Mass Spect. Rev. 1986 5, 467–519. *Electrohydrodynamic mass spectrometry.*
4. Duelcks, T., Roellgen, F. W. J. Mass Spectrom. 1995 30, 324–332. *Ion source for electrohydrodynamic mass spectrometry.*
5. (a) Fenn, J. B.; Mann, M.; Meng, C. K.; Wong, S. F.; Whitehouse, C. M. Science 1989, 246, 64–70. *Electrospray ionization for mass spectrometry of large biomolecules.* (b) Fenn, J. B.; Mann, M.; Meng, C. K.; Wong, S. F.; Whitehouse, C. M. Mass Spectrom. Rev. 1990, 9, 37–70. *Electrospray ionization-principles and practice.*
6. (a) Mahoney, J. F., Perel, J., Lee, T. D., Legesse, K.; A theoretical and experimental basis for producing very high mass biomolecular ions by electrohydrodynamic emission; presented at the 27th IEEE Industry Applications Society Annual Meeting, Atlanta, Ga., Oct. 18–23, 1987. (b) Lee, T. D., Legesse, K., Mahoney, J. F., Perel, J.; An EHD source for the mass spectral analysis of peptides; Proceedings of the 36th ASMS Conference on Mass Spectrometry and Allied Topics, San Francisco, Calif., Jun. 5–10, 1988. (c) Lee, T. D., Legesse, K., Mahoney, J. F., Perel, J.; Electrohydrodynamic emission mass spectra of peptides; Proceedings of the 37th ASMS Conference on Mass Spectrometry and Allied Topics, Miami Beach, Fla., May 21–26, 1989. (d) Mahoney, J. F., Perel, J., Lee, T. D., Husain, S., Todd, P. J., Cook, K.; Electrohydrodynamic ion source design for mass spectrometry: Ionization, ion optics and desolvation; Proceedings of the 38th ASMS Conference on Mass Spectrometry and Allied Topics, Tucson, Ark., Jun. 3–8, 1990.

7. Ikonomou, M. G.; Blades, A. T.; Kebarle, P. Anal. Chem. 1991, 63, 1989–1996. *Electrospray-ion spray: A comparison of mechanisms and performance.*
8. Grace, J. M.; Marijinissen, J. C. M. J. Aerosol Sci. 1994, 25, 1005–1019. *A Review of liquid atomization by electrical means.*
9. Chowdhury, S. K., Viswanatham, K., Chait, B. T. Rapid Comm. Mass Spectrom. 1990, 4, 81–87. *An electrospray ionization mass spectrometer with new features.*
10. Prewett, P. D.; Mair, G. L. R. Focused Ion Beams from Liquid Metal Ion Sources; Research Studies Press, Ltd.: Somerset, England, 1991.
11. Kebarle, P. and Tang, L. Anal. Chem. 1993, 65, 972A–986A. *From ions in solution to ions in the gas phase, The mechanism of electrospray mass spectrometry.*
12. Lewis, K. C., Dohmeier, D. M., Jorgenson, J. W., Kaufman, S. L., Zarrin, F., Dorman, F. D., Anal. Chem. 1994, 66, 2285–2292. *Electrospray-condensation particle counter: A molecule-counting LC detector for macromolecules.*
13. Bailey, A. G. (ed.) "Chapter 8 Further Applications of Charged Drops", pp. 171–176, IN Electrostatic Spraying of Liquids, Research Studies Press Ltd.: Somerset, England, 1988.
14. Zeleny, J. Proc. Camb. Phil. Soc, 1915, 18, 71–83. *On the conditions of instability of electrified drops, with applications to the electrical discharge from liquid points.* (b) Zeleny, J. Phys. Rev. 1917, 10, 1–6. Instability of electrified liquid surfaces.
15. Taylor, G. I. Proc. R. Soc. 1969, A313, 453–475. *Electrically driven jets.*
16. de la Mora, J. F., Loscertales, I. G. J. Fluid Mech. 1994, 260, 155–184. *The current emitted by highly conducting Taylor Cones.*
17. (a) Gomez, A., Tang, K. Phys. Fluids 1994,6, 404–414. *Charge and fission of droplets in electrostatic sprays.* (b) Gomez, A., Tang, K. Phys. Fluids 1994,6, 2317–2332. *On the structure of an electrostatic spray of monodisperse droplets.*
18. Luttgens, U., Dulcks, T., Rollgen, F. W. Surface Science 1992, 266, 197–203. *Field induced disintegration of glycerol solutions under vacuum and atmospheric pressure conditions studied by optical microscopy and mass spectrometry.*
19. Le Blanc, J. C. Y.; Guevremont, R.; Siu, K. W. M. 1993, Int. J. Mass Spectrom. Ion Proc. in press. *Electrospray mass spectrometry of some proteins and the aqueous solution acid/base equilibrium model in the negative ion detection mode.*
20. Ikonomou, M. G.; Blades, A. T.; Kebarle, P. J. Am. Soc. Mass Spectrom. 1991, 2, 497–505. *Electrospray mass spectrometry of methanol and water solutions suppression of electric discharge with $SF_6$ gas.*
21. Dohmeier, D. M., Ph.D. Dissertation, University of North Carolina, Chapel Hill, N.C. 1991; Chapter 4, Electrospray in vacuum as a potential interface between open tubular liquid chromatography and mass spectrometry; pp. 92–172; IN: Open tubular liquid chromatography: Studies in column efficiency and detection.
22. Platzer, B.; "Process and device for feeding liquid samples to mass spectrometers by electrostatic nebulisation," WO Patent 95/34089 (Dec. 14, 1995).
23. Jorgenson, J. W. and Dohmeier, D. M.; "Microelectrospray method and apparatus," U.S. Pat. No. 5,115,131 (May 19, 1992).
24. Fenn, J. B., Yamashita, M., Whitehouse, C.; "Process and apparatus for changing the energy of charged particles contained in a gaseous medium," U.S. Pat. No. 4,542,293 (Sep. 17, 1985).
25. Rayleigh, Lord Proc. Phil. Mag. Series, 1882, 5, 184–186. *On the equilibrium of liquid conducting masses charged with electricity.*
26. Mann, M., *Organic Mass Spec.* 25:575 (1990).
27. Michelson, D. *Electrostatic Atomization* IOP Publishing, Ltd. Bristol, England (1990).

SUMMARY OF THE INVENTION

The present invention is intended to overcome many of the aforementioned limitations of conventional atmospheric pressure electrospray and low pressure electrohydrodynamic (EHD) devices by physically separating the primary aerosol generation process from the secondary aerosol and ion generation processes and discretely optimizing both. The primary process of cone-jet formation is controlled by thermal and electrostatic means to facilitate the formation of a directionally stable liquid cone-jet. Once a stable cone-jet is formed, the jet and resulting droplets are introduced into a evaporation region where the secondary aerosol is generated and the ion generating processes take place.

A liquid solution is introduced through a needle, held at high electrical potential, into a first chamber maintained at reduced pressure to produce a stable electrospray cone-jet. The product of this primary process is intended to be a highly charged liquid jet and droplets from an electrospray source directed on the axis of a counterelectrode (see FIG. 1). In contrast, other devices used in low pressure ES systems are typically operated to produce ions directly from the primary cone.[43,4,6] The pressure in the first chamber of the present device is maintained below the pressure at which electrical discharge occurs, typically less than 0.1 Torr. Ancillary heating of the tube may be required in the first chamber to prevent freezing of the liquid from evaporative cooling.

The liquid cone-jet in the present device is stabilized by the electrostatic lens surrounding the capillary resulting in a constant (in time) conical geometry with a constant (in space) axial direction associated with the liquid jet. The liquid jet under influence of surface tension will break into droplets that will continue in the axial direction of the jet. The present invention takes advantage of the extremely small axial cross-section of the liquid jet and droplets and their high axial velocity, to sample all of this jet of liquid across a high pressure gradient through a small cross sectional aperture into a higher pressure region. The aperture size is selected for efficient transfer of liquid through the aperture and in order to maintain pressure requirements in both the first chamber (to prevent discharge) and the second chamber (to desolvate, breakup ion clusters, form ions, react species, and focus ions).

A key aspect of the present method of ion generation is the precise alignment of the liquid jet with the sampling aperture located in the wall of the first chamber leading into the second chamber. This alignment allows virtually all analyte in solution to be introduced into the second chamber. The alignment of the jet may be accomplished with either mechanical translational adjustment, and/or electrostatic or magnetic steering. The stability of the cone-jet is also dependent upon the geometry and spatial relationship of the stabilizing electrode; and the stability of the liquid flow.

Once the liquid jet is aligned with the aperture, the high velocity highly charged jet and primary droplets are introduced into the higher pressure chamber (the second chamber) in order to more efficiently conduct heat to the droplets causing the evaporation of the volatile components in the droplets. The extent of evaporation in the second chamber is regulated by a controlled heat supply, the gas composition, gas pressure and the geometry of the region. As the droplet decreases in size, due to the evaporation of the volatile components, the density of charges on the surface of the droplet increases, driving the highly charged droplets to the limit of charging, sometimes called the "Rayleigh limit".[25] At this point the primary droplets deform and emit secondary droplets, ion clusters, or ions. The secondary droplets undergo further evaporation and a subsequent emission of droplets, ion clusters and ions. The ions that leave the droplets may be highly solvated or clustered. Collision of ions and/or ion clusters with the residual background gas(es) or other ions in this higher pressure region will be sufficiently energetic to decluster the adducts and leave intact gas phase molecular ions formed from the electrospray process. These ions can then be focused, analyzed, and detected by conventional means, such as a mass spectrometer. Examples of mass spectrometers; include, (but are not limited to) time-of-flight, ion traps, fourier transform, quadrupole, magnetic sector, and tandem instruments.

Because the second chamber affords a degree of isolation of the ion generation processes from the primary droplet charging process, alternative operating conditions are compatible with the present device. For example, the second chamber can be pressurized with helium (a highly conductive gas) to induce efficient desolvation. This gas results in a gas discharge when used with conventional electrospray devices, at atmospheric pressure. Another example, would be the use of high energy sources, such as, dc and rf discharges, to augment both desolvation, ionization processes, and fragmentation. The second chamber could also serve as a reaction chamber for a variety of processes, as a collector or trap of selected ions for storage and/or subsequent analyze (e.g. quadrupole trap, potential well trap).

The restriction of the total mass flow into the vacuum system with the present devise significantly reduces the system pumping requirements when compared to conventional ES devices. The production of a stable cone-jet at reduced pressures minimizes the problems associated with gas discharge in atmospheric pressure modes of operation, particularly in negative ion mode. The collection of virtually the entire primary aerosol into a higher pressure region allows efficient ion production and declustering and eliminates problems associated with other low pressure ES devices, such as, spatial and directional instabilities and cluster formation. Since ion production occurs in close proximity to the mass analyzer or other gas phase ion detectors, the transport losses compared with atmospheric ES operation are not as significant.

Another embodiment of the present invention provides an improved ES apparatus that receives solvated ions without pressure reduction, produces desolvated ions with non-conductive energy, and outputs the desolvated ions towards a mass spectrometer, thereby resulting in improved ion collection efficiency.

The present invention provides a desolvation chamber interfaced with a lower pressure ES chamber to avoid the pressure reduction featured in prior ES techniques. The desolvation chamber stabilizes cone-jet formation in the ES chamber and desolvates the incoming analyte ions of the cone-jet with non-conductive energy and outputs the ions, thereby minimizing gas load, allowing cone-jet formation at extremely high voltages, reducing ion clustering, and substantially improving ion collection efficiency for MS.

The desolvation chamber according to the invention achieves these objectives by avoiding pressure reduction prior to desolvation, and providing a suitable chamber configuration and operating voltage to positively impact the flow of solvated analyte ions in the cone-jet from the ES chamber. Inside the desolvation chamber, the cone-jet is exposed to non-conductive energy (e.g., heated gas) to substantially remove solvent from the solvated analyte ions. The desolvated analyte ions so produced are then outputted towards a mass spectrometer as a substantially solvent free ion beam suitable for MS analysis.

BRIEF DESCRIPTION OF THE DRAWINGS

This invention will be described in greater detail by reference to the drawings, in which.

DETAILED DESCRIPTION

Figure 1:
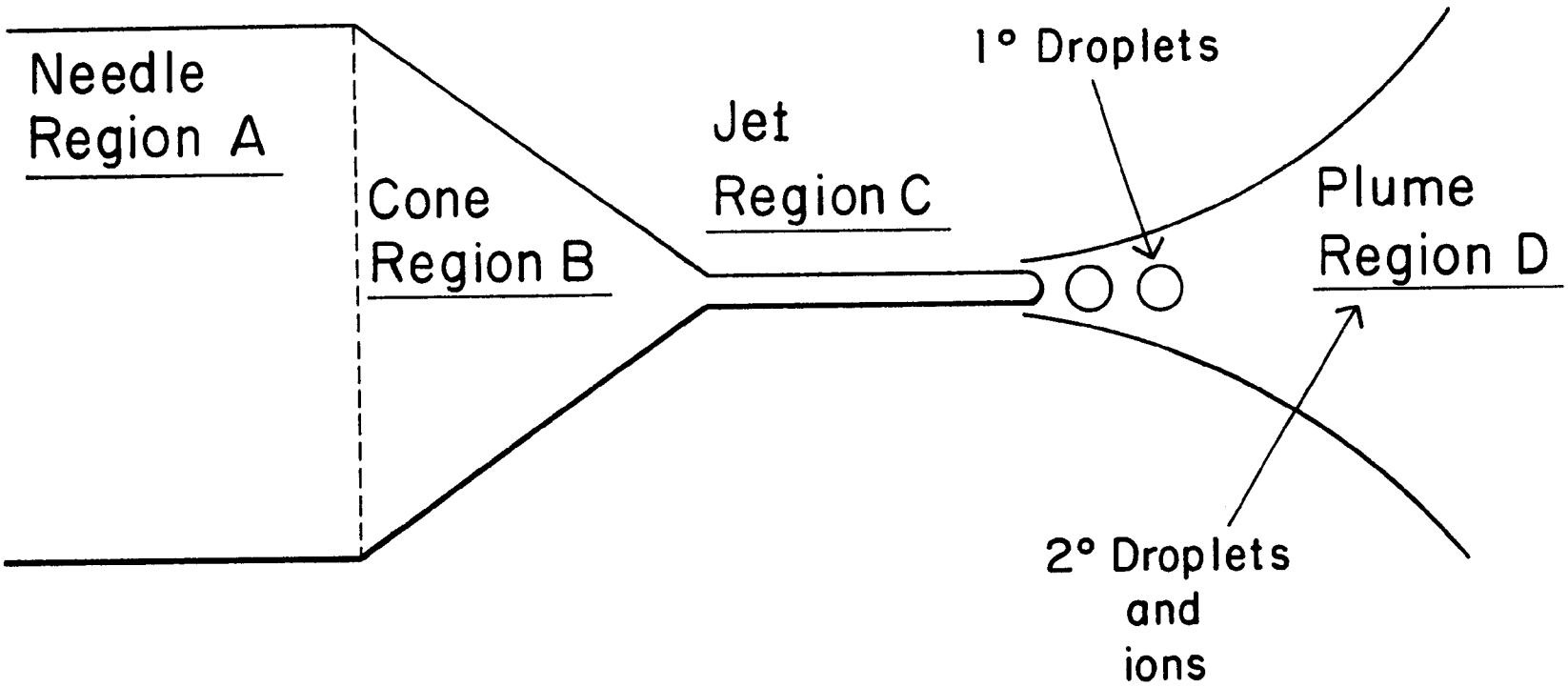
FIG. 1 is a schematic diagram of the regions (Region A: Needle, Region B: Cone, Region C: Jet, Region D: Plume) associated with electrospray aerosol generation and ionization.
Figure 2:
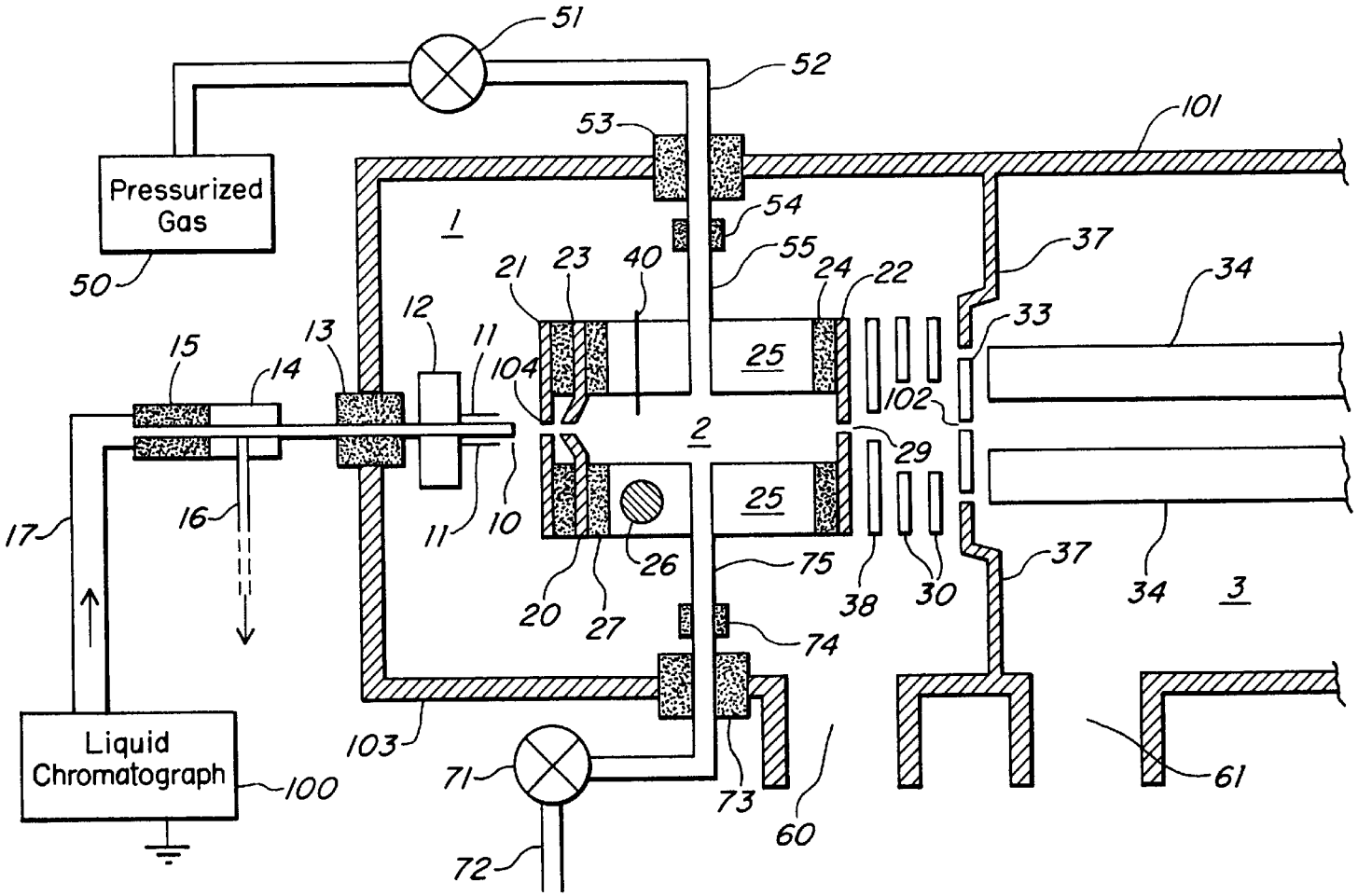
FIG. 2 is a schematic cross-sectional diagram of a first embodiment of the present invention with a differentially pumped vacuum system in a liquid chromatography mass spectrometer implementation.

FIG. 2 shows a first embodiment of the invention. In this embodiment, liquid (for example, the effluent from a liquid chromatograph) flows within tubing 17 in the direction of the arrow and all or a portion of the liquid is caused to flow out of capillary tube 10. Excess liquid flows out of conduit 16 in a flow splitter configuration. Insulator tube 15 joins onto tee 14 and is composed of an electrically insulating material. Insulator tube 15 is of sufficient length, internal diameter, and total resistance to maintain an electrical potential difference between the high voltage power supply and the liquid chromatograph, which is at ground. Tee 14 is composed of electrically conducting material, usually stainless steel. Tee 14 is connected to a high voltage power supply which can be regulated in terms of voltage, current, a combination of current and voltage, and possibly modulated. Tee 14 may be kept at several thousand volts, but is not limited to this. The portion of the liquid that flows through capillary tube 10 also flows into vacuum chamber 1, through a vacuum seal 13 composed of an electrically insulating material, such as glass, or lexan, which also provides mechanical support for capillary tube 10. Capillary tube 10 may be composed of an insulating or metallic material.

An electrode or coaxial cylindrical tube 11 is located coaxially to the capillary tube 10. For liquid cone-jet stability, electrode 11 is a coaxial cylindrical tube but not limited to this specific geometry (e.g., plate(s), quadrupole, octopole). Coaxial cylindrical tube 11 is composed of electrically conducting material, usually stainless steel. Coaxial cylindrical tube 11 is also at a high electrical potential which is adjustable to maintain a stable axial spray. Adjuster 12 is affixed to both tubes 10 and 11 and allows mechanical alignment of these tubes relative to one another and relative to the entrance lens 21.

Figure 3:
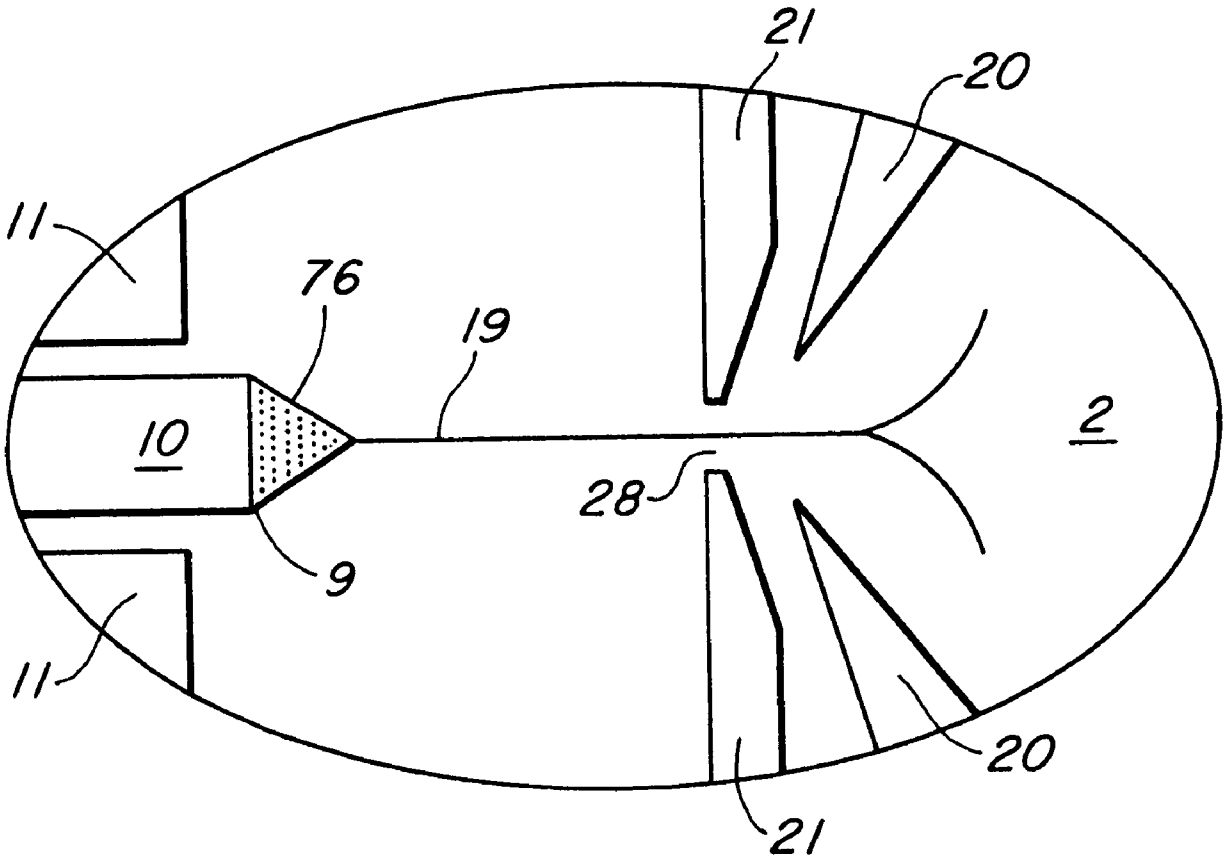
FIG. 3 is a detailed cross-sectional diagram of a preferred embodiment of the invention showing an expanded view of the capillary tube, the cone-jet in chamber 1 being steered through an entrance lens into the higher pressure chamber, chamber 2.

FIG. 3 is an expanded view of the cone-jet region of the first embodiment. Liquid cone 76 emerges from the tip 9 of the capillary tube 10 and forms a liquid jet 19 moving in the direction of entrance lens 21. The alignment of the liquid jet 19 with exit or pinhole aperture 28 is performed with adjuster 12 to ensure the liquid flows into chamber 2.

As seen in FIG. 2, the second chamber 2 is separated from chamber 1 by means of an entrance lens 21 and skimmer lens 22. Inside chamber 2 is an additional focusing lens 20. All three lens are made of metal and serve as focusing lens for ions and charged particles. Entrance lens 21 is isolated from focusing lens 20 by insulator 23 and in turn, focusing lens 20 is isolated from chamber 2 by insulator 27. Skimmer lens 22 is isolated from chamber 2 by insulator 24. The housing of chamber 2 is made of metal and serves as a focusing lens for ions and charged particles contained in chamber 2. The volume, length and geometry is chosen to minimize surface losses of analyte and maximize transport of ions.

A conductive gas, such as nitrogen or helium but not limited to such gases, is added to chamber 2 through gas tube 52 from a pressurized gas container 50 in sufficient quantity to maintain chamber 2 at a pressure greater than either chambers 1 or 3. Gas tube 52 enters chamber 1 through vacuum feedthrough 53 and is electrically isolated from gas inlet tube 55 by means of an electrically insulating union 54. Electrically insulating union 54 is composed of a gas impermeable electrically insulating material such as glass, or ceramic but not limited to this specific material. Gas inlet tube 55 then joins chamber 2. Gas tube 52 and gas inlet tube 55 are made of a material impermeable to gas such as metal, but not limited to this specific material Gas may be removed from chamber 2 through exit port 72. This exit port 72 may be pumped by a mechanical pump (not shown) to maintain an effective pressure in chamber 2 greater than either chambers 1 or 3. Exit port 72 enters chamber 1 through vacuum feedthrough 73 and is electrically isolated from gas outlet tube 75 by an electrical insulating union 74. Electrically insulating union 74 is composed of a gas impermeable electrically insulating material such as glass, or ceramic but not limited to this specific material. Gas outlet tube 75 then joins chamber 2. Exit port 72 and gas outlet tube 75 are made of a material impermeable to gas such as metal, but not limited to this specific material. The flow, pressure and composition of gas(es) into chamber 2 are controlled by a combination of the gas manifold (not shown), adjustable gas inlet valve 51, gas outlet valve 71, and sizes of apertures 28 and 29. Chamber 2 is heated by a heater cartridge 26 imbedded in the chamber wall 25, and a thermocouple (not shown) attached to the chamber indicates the temperature and couples to a temperature controller to adjust the heater power to maintain the desired temperature.

Ions, any residual charged droplets or particles and the added gas exit from chamber 2 through skimmer lens 22 located on axis with the entrance lens 21 into chamber 1. Skimmer lens 22 is electrically isolated from the chamber 2 so that a potential can be applied to cause ions to drift toward lens 22 and thus increase the fraction of ions that exit through aperture or pinhole aperture 29 of said skimmer lens 22. The ions exit from chamber 2 into associated ion optics (planar lens 30, planar entrance lens 33, extractor lens 38) used for focusing ions into the mass analyzer 34.

Adjacent to chamber 2 and along the longitudinal axis of chamber 2, inside chamber 1 at high vacuum, is an element or extractor lens 38 to which electrical potentials are applied for accelerating the ions away from the aperture 29 of skimmer lens 22. Adjacent to extractor lens 38 and along the longitudinal axis of chamber 2 and extractor lens 38, are one or more planar lenses 30 which are used to focus ions into planar entrance lens 33, from whence they proceed into the mass analyzer 34 and are detected by a detector which is normally an electron multiplier but can be a Faraday cage or other conventional device for registering the arrival of ions (not shown). A quadrupole mass filter is shown to be the mass analyzer.

The mass analyzer is located in vacuum chamber 3 which must be maintained at $10^{-5}$ torr or below for normal operation. An isolator wall 37 divides chambers 1 and 3 and contains a planar entrance lens 33. Planar entrance lens 33 is electrically isolated from isolator wall 37. Chamber 3 is evacuated through exit port 61. In this differently pumped embodiment, higher pressures and associated gas loads can be accommodated in chamber 1 while still maintaining normal operating pressures in chamber 3.

Figure 4:
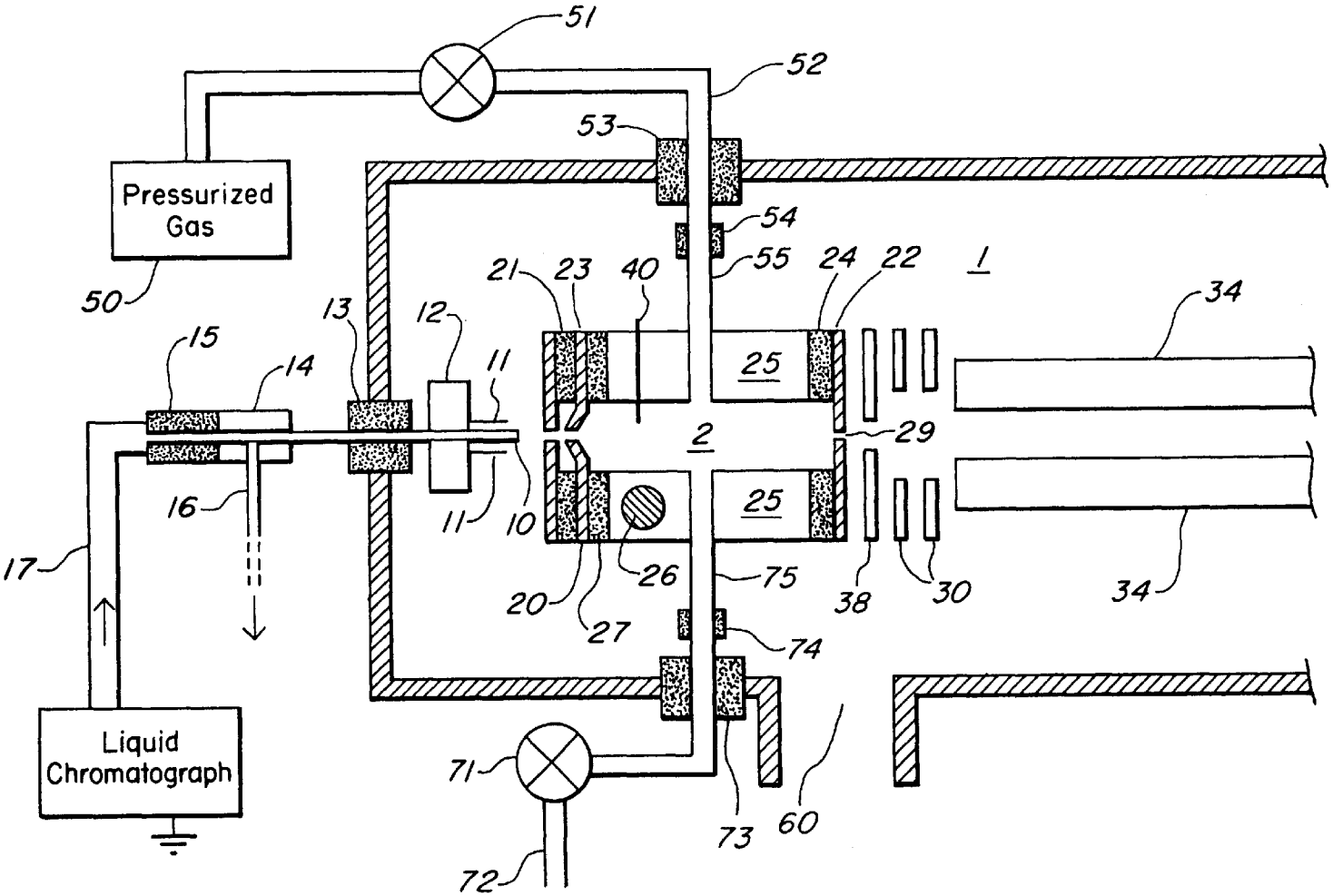
FIG. 4 is a detailed cross-sectional diagram of an alternative vacuum configuration for the present device.

FIG. 4 illustrates a second embodiment of the invention where chamber 2, mass analyzer 34 and associated ion optics (planar lens 30, extractor lens 38) all reside inside the same chamber, chamber 1. Chamber 1 is a region of high vacuum, evacuated through pumping port 60. In contrast to the said first embodiment (a differentially pumped system, as shown in FIG. 2), a larger pump would be required to evacuate chamber 1 through pumping port 60 to maintain a normal operating pressure of $10^{-5}$ torr or below if the same size apertures (28 and 29) for entrance lens 21 and skimmer lens 22 are used in this said second embodiment.

A third embodiment of the invention is a variation of the second embodiment, where apertures 28 and 29 for entrance lens 21 and skimmer lens 22 are smaller than those used in either the first or second embodiments. In this said third embodiment the pressure in chamber 1 could be maintained at normal operating pressure for the mass analyzer with a similar pump use in said first embodiment (a differentially pumped system). In said second and third embodiments of the invention, the planar lens 30 focuses ions directly into the mass analyzer 34 rather than through planar entrance lens 33.

Further Description of the First Embodiment

The first embodiment, as illustrated in FIG. 2, comprises a desolvation chamber that receives a cone-jet from a lower pressure ES chamber and desolvates the analyte ions of the cone-jet with non-conductive energy, thereby forming an ion beam suitable for MS. In this embodiment, the desolvation chamber is interfaced with an LC unit, which LC unit provides a continuous stream of analyte dissolved in one or more solvents suitable in an HPLC implementation. The analyte is provided to the desolvation chamber as a stable cone-jet from the low pressure ES chamber. The function of the desolvation chamber is to stabilize and receive the cone-jet, to desolvate the analyte ions of the cone-jet, and to output a substantially solvent-free ion beam towards a mass spectrometer.

This embodiment can be used to produce desolvated ions from a variety of molecules of medicinal, forensic or commercial interest including, e.g., small ions, proteins, polypeptides, peptides, nucleic acids, oligosaccharides, sugars, fats, lipids, lipoproteins, glycoproteins, synthetic polymers, metalloproteins, organometallic compositions, toxins (e.g., pesticides and carcinogens), drugs and pharmaceuticals.

Figure 5A:
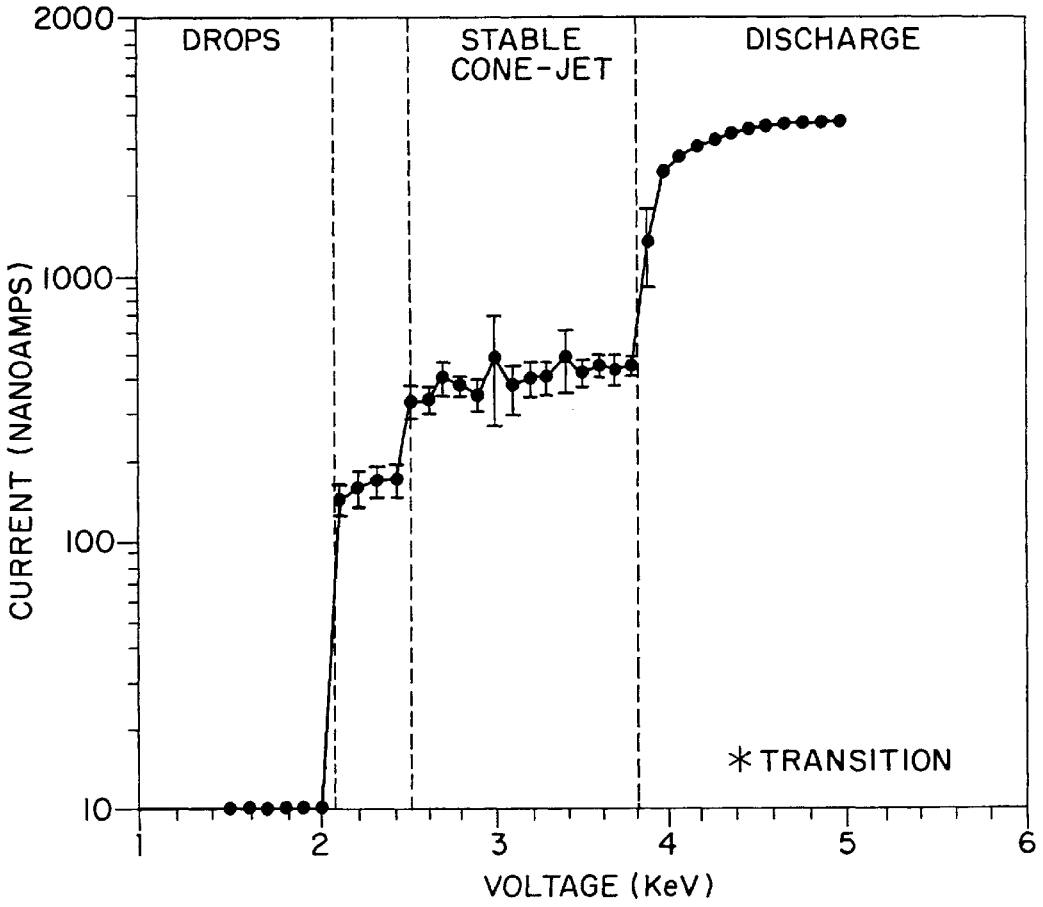
FIG. 5A is a graph illustrating current onset for a flowing stream of methanol in air through an electrospray needle.
Figure 5B:
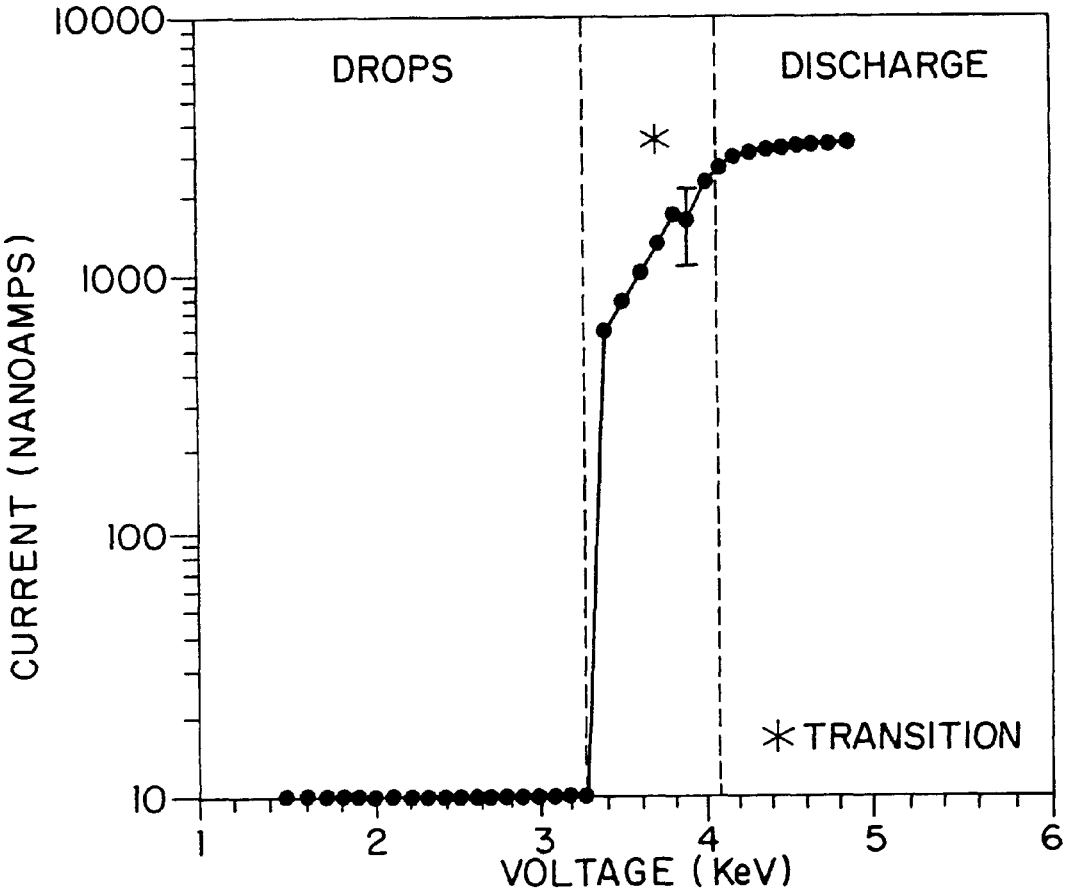
FIG. 5B shows the current onset for a flowing stream of water in air through the needle.

Referring now to FIG. 5A, ES operating regions for methanol solvent are shown as a current vs. voltage curve. The flow rate was 1 $\mu$L/min and the needle included aluminum coated fused silica (28 $\mu$m ID×300 $\mu$m OD). FIG. 5B shows the current onset for a flowing stream of water solvent in air through the needle. Note the rather wide plateau region where a stable cone-jet forms with methanol (FIG. 5A) and the much narrower region seen with water (FIG. 5B). These curves identify gas discharge regions with respect to the particular solvents and ranges of current and voltage depicted. Other current vs. voltage curves can be readily illustrated using other solvents or mixtures of solvents.

Figure 6:
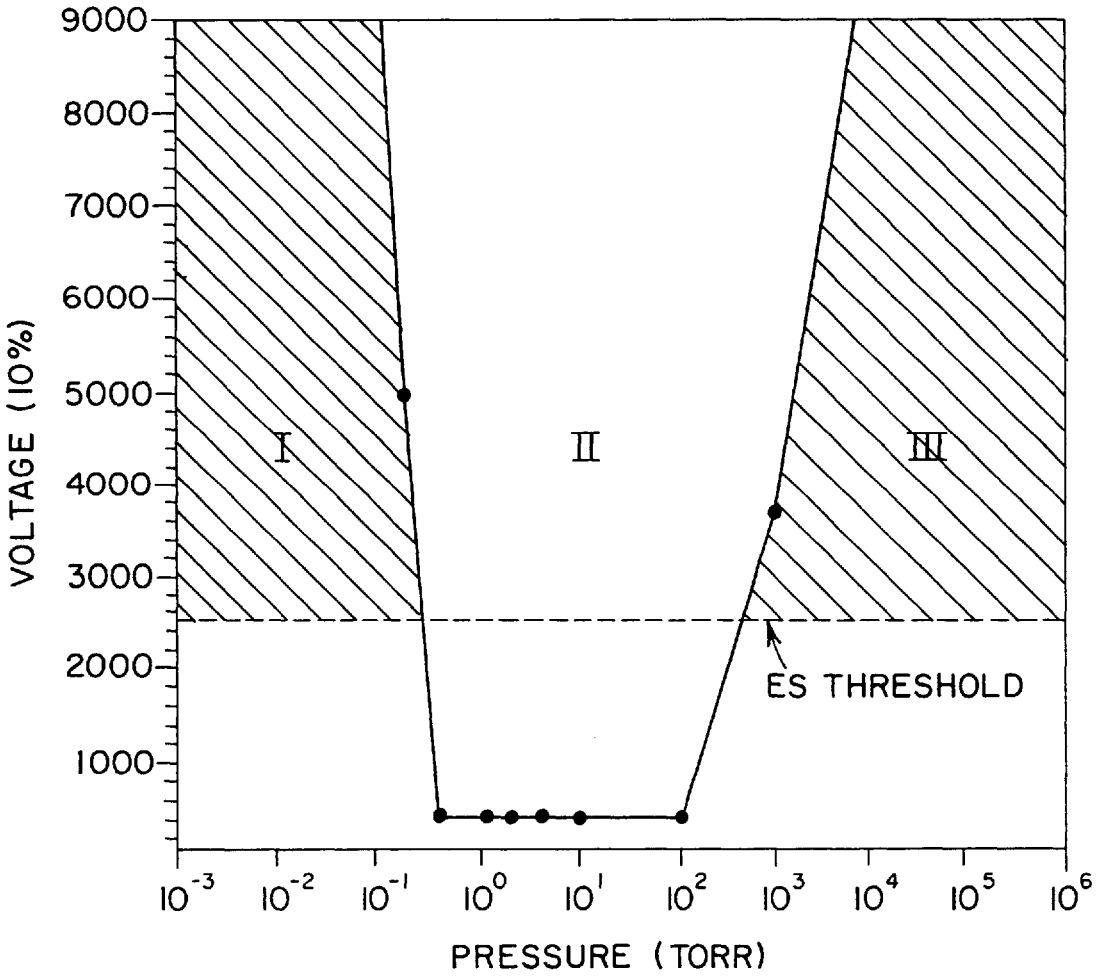
FIG. 6 is a graph showing the voltage threshold of discharge vs. chamber pressure.

A current/voltage graph illustrating pressure regions of ES operation is shown in FIG. 6. For example, region I is the low pressure ES region where no discharge occurs and a stable cone-jet can be made. Region II is the discharge region where no cone-jets are observed because current is dissipated through the gas phase. Region III is the atmospheric pressure domain associated with most prior art ES systems. The dotted line is the onset voltage for cone-jet formation; below which no ES occurs. The hashed lines show distinct regions for ES operation. The ES devices of the present invention generally operate in region I.

Turning again to FIG. 2, this embodiment is suitable for accepting a liquid sample from an LC unit 100 and producing desolvated ions suitable for analysis in a mass spectrometer or analyzer 34. Generally, samples injected into the LC unit 100 are separated on a column, and elute sequentially in a flow of liquid which typically may be in the ml $min^{-1}$ range depending on the particular LC unit. The liquid composition may vary from essentially pure water to essentially pure organic solvent such as methanol, and both solvent components may contain additives such as organic acids (e.g., formic acid) or inorganic buffers. Other suitable solvents include benzene, acetone, ethyl ether, ethanol, butyl alcohol, acetonitrile, a straight chain hydrocarbon such as n-hexane; or suitable mixtures thereof. The LC unit 100 can be, for example, a micro-bore high performance liquid chromatographic (HPLC) unit. Alternatively, the LC unit 100 can be substituted with a capillary zone electrophoretic (CZE) unit.

The liquid effluent from LC unit 100 is transferred to an electrospray needle 10 through a length of substantially non-conductive capillary tubing 17, such as fused silica. Suitable dimensions of the capillary tubing will vary depending on the LC unit chosen, but will generally be on the order of about 50 to 200 microns in internal diameter and from about 0.1 to 5 meters in length. Suitably, the dimensions of the substantially non-conductive tubing 17 are chosen to provide a sufficient electrical resistance between the electrospray needle 10 and the LC unit 100 (which is preferably grounded). The substantially non-conductive tubing 17 is joined to electrospray needle 10 through non-conductive fittings 13 and 15, whereby non-conductive fitting 15 may also function as a "splitter" with excess fluid exiting via conduit 16. A voltage typically in the range of about 2.5 to 10 kV is applied to the electrospray needle 10 by a high voltage supply, which supply may be connected to the electrically conductive adjuster 12 attached to electrically conductive capillary tube 11. The voltage is adjusted relative to the electrospray housing wall 103 until a suitable spray of highly charged droplets is produced.

Fluids entering low pressure chamber 1 from needle 10 arrive in the form of a cone-jet. As the highly charged droplets of the cone-jet vaporize in low pressure chamber 1, molecular ions are released from the droplets into a gas phase (desorption). A vacuum pump exit port 60 having an approximate diameter of about 1 to 20 cm, preferably 5 to 10 cm, connected to a vacuum pump (not shown) with a nominal capacity of about 0.2 to 1000 cubic meters per hour, maintains low pressure chamber 1 at between about 1 Torr to $10^{-4}$ Torr. By introducing the cone-jet into low pressure chamber 1 in accordance with the present invention, significant benefits are achieved such as: reduction of total gas load on the vacuum system; formation of charged droplets at extremely high voltage without significant discharge; and elimination of the pressure reduction prior to desolvation.

A portion of the cone-jet in low pressure chamber 1 impinges on an entrance lens 21. The remainder of the ions (and any residual charged droplets or particles) exit low pressure chamber 1 through the entrance lens 21 (maintained at a more negative potential relative to earth than needle 10), through an orifice 28 to a desolvation chamber 2. The diameter of orifice 28 is generally in the range of from about 50 to 1000 microns, preferably about 400 to 500 microns.

The cone-jet emerging from low pressure chamber 1 passes through the orifice 28 which is between the entrance lens 21 and a focusing lens 20. Focusing lens 20 suitably directs the cone-jet to the desolvation chamber 2, and along with the entrance lens 21, is electrically isolated and spaced by first non-conductive gaskets 23 and 27.

The cone-jet enters the desolvation chamber 2 with a reduced rate of evaporation, in part because insufficient heat was conducted to the cone-jet in low-pressure chamber 1 to cause efficient evaporation. To induce more efficient evaporation, a non-conductive form of energy, i.e. non-electrical, is applied to the charged droplets to provide a heat of vaporization. Exemplary forms of non-conductive energy include radiative energy, e.g. from a resistively-heated filament, laser or other suitable emitter which produces light capable of being absorbed by the cone-jet. Thermal energy can also be used, as provided from a resistively-heated member, such as a cesium ion gun. Collisional energy, e.g. from pressurized gas, can also be used to provide a non-conductive form of energy applied to the charged droplets to affect heat of vaporization to induce more efficient evaporation. Suitable combinations of the foregoing forms of non-conductive energy can be implemented. More particularly, by providing sufficiently high pressure and temperature, enough non-conductive energy is transferred to the incoming cone-jet to reduce vapor condensation, and to achieve efficient heat transfer, ionization and declustering.

The desolvation chamber 2 achieves this goal by stabilizing the cone-jet and providing non-conductive energy to desolvate the cone jet. The operating pressure is suitably maintained by connecting the chamber to a pressurized gas container 50 attached to a first gas tube 52 with a preferred length of between about 0.2 cm and 10 cm. An adjustable gas inlet valve 51 is used to control flow of a gas entering the chamber. Generally, appropriate types of gas include argon, nitrogen or helium. The gas tube 52 carrying the gas, crosses the electrospray housing wall 103 through a first non-conductive compression bulk-head fitting 53 and 54 before entering the desolvation chamber 2 through a desolvation chamber wall 25. A preferred non-conductive compression bulk-head fitting is a Swagelok™. The desolvation chamber 2 is heated by a heater cartridge 26 imbedded in the desolvation chamber wall 25. A thermocouple (not shown) attached to the chamber indicates the temperature and is operatively coupled to a temperature controller configured to adjustably maintain the desired temperature. An electrical power supply provides power to the heater cartridge 26 and is regulated by a controller responsive to a temperature sensor (not shown). The chamber is maintained at a pressure of between about $10^{-3}$ Torr to 10 Torr, preferably between $10^{-2}$ and 1 Torr, and at a temperature of between about 50° C. to 400° C., preferably about 100° C. to 200° C. Under these conditions, the gas leaves the desolvation chamber 2 through orifices 28 and 29, and a gas outlet tube 75 with a preferred length of about 0.2 cm to 10 cm. Typically, the desolvation chamber 2 will have a symmetrical configuration with respect to an axis (not shown) passing through centerpoints of the orifices 28 and 29 and focusing lens 20. For example, desolvation chamber 2 can be configured as a square, rectangle, circle, or tube with an ID of between about 0.5 cm to 50 cm.

Pressurized and heated gas leaves the desolvation chamber 2 through the gas outlet tube 75 which crosses the electrospray housing wall 103 through a compression bulk-head fitting 73 and 74. An adjustable valve 71 is attached to the gas outlet tube 75 and provides another means of controlling the pressure of the gas in the desolvation chamber 2 before it leaves the valve at an exit port 72. It may be desirable to attach a pump to the exit port 72. Likewise, by pre-heating the gas entering desolvation chamber 2 to the temperature of the desolvation chamber wall 25, solvent condensation can be further reduced or avoided.

The optimum relative voltages applied to the elements of the desolvation chamber are typically dependent upon compounds and mobile phases in use. In general, they range between 1 and 300 volts and are set so as to optimize efficient transmission of the ion beam through the chamber without compromising efficient desolvation or inducing ion fragmentation.

Desolvated ions are outputted from the desolvation chamber 2 through skimmer lens 22 which is adjustably mounted by a second non-conductive gasket 24. The orifice or aperture 29 of the skimmer lens 22 is located on the axis passing through the centerpoints of the orifice or aperture 28 and focusing lens 20. Skimmer lens 22 and the non-conductive gasket 24 are electrically isolated from the desolvation chamber wall 25 so that a potential difference can be applied between the entrance lens 21 and skimmer lens 22 to directionally propel the desolvating ions toward skimmer lens 22 to increase the fraction of desolvated ions exiting the aperture 29 as ion beam 102. Generally, the diameter of aperture 29 will be comparable to aperture 28, e.g., between about 50 microns to 1000 microns in diameter, preferably between about 300 microns to 600 microns in diameter. The ion beam 102 enters focusing lenses 38 and 30 and travels towards a lens 33 imbedded in isolator wall 37. The potential of skimmer lens 22 relative to lens 33 positively impacts the energy and stability of the ion beam 102 as it travels to an input chamber of a mass spectrometer or analyzer 101 through lens 33. The mass spectrometer or analyzer is evacuated by a conventional mechanical pump (not shown) connected to an exit port 61 which maintains the pressure below about $10^{-5}$ Torr.

The dimensions and voltages applied to the focusing lenses 38, 30, 33 may, by appropriate selection, be used to additionally decluster any solvated ions, and to optimize the transmission of the ion beam into quadrupole filter 34. These procedures are well known to those skilled in the art.

The present invention is thus useful to detect and determine the molecular weight and structure of an analyte present in the liquid effluent even though the analyte may be present in very small amounts. The mass spectrometer or analyzer 34 in the present illustrative embodiment is a quadrupole mass filter. A quadruple mass analyzer is frequently preferred for use with the LC unit 100. However, it should be appreciated that other types of mass spectrometers or analyzers, such as magnetic sector, TOF (time-of-flight), or Ion Cyclotron Resonance (ICR) analyzers may also be used. Additionally, RF-only multipole structures for ion cooling, which are well known, may advantageously be inserted between the desolvation chamber and the mass analyzer.

Accordingly, the mass spectrometer or analyzer 34 may receive the ion beam 102 centrally passing through an electrical field generated by the device. According to their mass-to-charge ratio (m/z), the ions are either deflected or transmitted by the electrical field, and the transmitted ions may be detected by nearly any standard electron multiplier detector. For the mass spectrometer or analyzer 34 to properly operate, the electric or magnetic field which deflects the ions is housed within a region 3 inside an input chamber 101 that is maintained at a vacuum of less than about $10^{-5}$ Torr by a vacuum pump exit port 61 capable of displacing approximately $150<1/s^{-1}$ at about atmospheric pressure.

Figure 7B:
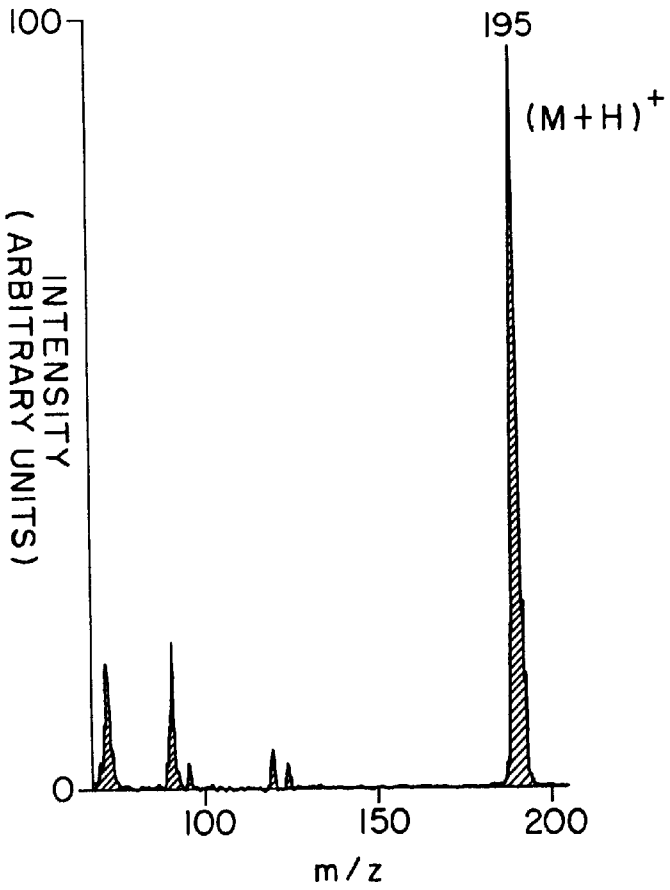
FIG. 7B is a positive-ion low pressure electrospray mass spectra of the first peak (elution time about 2.5 minutes) showing the presence of the protonated molecular ion (m/z 195 M+H) of caffeine.
Figure 7A:
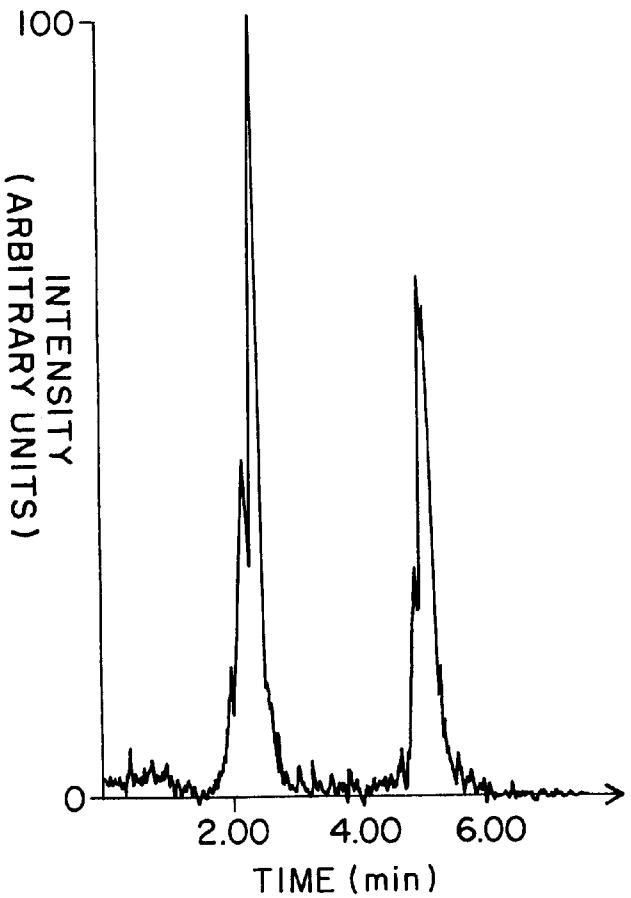
FIG. 7A is a mass spectrometry-selected ion chromatogram (m/z 190–199) of two flow injections of 500 ng of caffeine (MW 194, 500 ng/$\mu$L)
Figure 8:
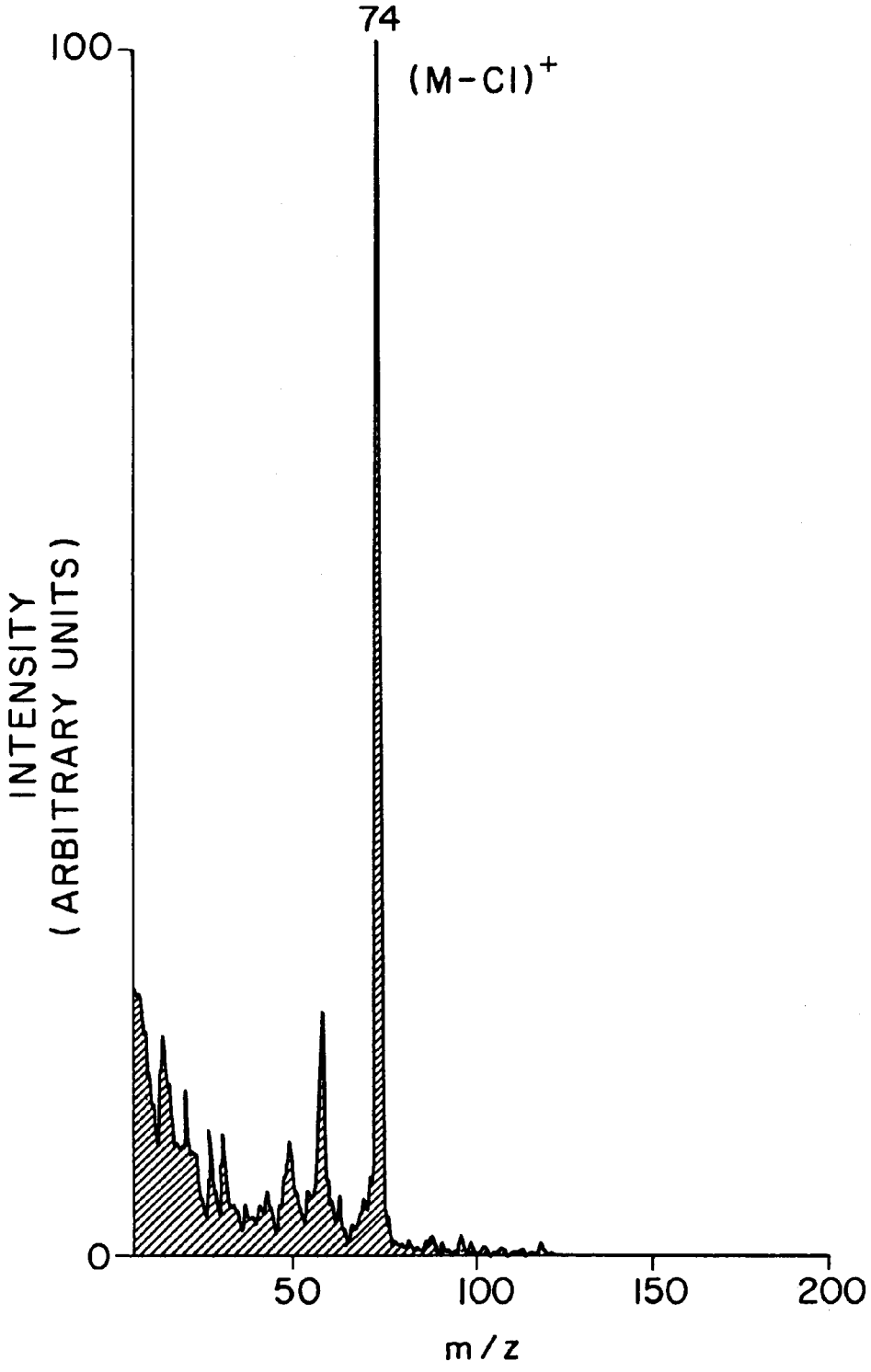
FIG. 8 is a positive-ion low pressure electrospray mass spectra from a flow injection of 500 ng of tetramethylammonium chloride.

The data illustrated in FIGS. 7A and 7B serve to demonstrate the principles delineated above. Using the aforementioned ES device illustrated in FIG. 2, mass spectral data have been produced which demonstrates lack of clustering and predominantly molecular weight information for purine, caffeine (FIGS. 7A and 7B) and quaternary ammonium salts (FIG. 8).

Although the invention has been shown and described with respect to an exemplary embodiment thereof, it will be appreciated from the foregoing that various other changes, omissions and additions in the form and detail thereof may be made therein without departing from the spirit and scope of the invention.

What is claimed is:

1. An apparatus for producing desolvated analyte ions for a mass spectrometer, the apparatus comprising:

an electrospray unit receiving a liquid sample comprising analyte and discharging said analyte as a cone-jet, said electrospray unit comprising an electrospray unit housing defining a pressure region below atmospheric pressure and a desolvation unit receiving said cone-jet and outputting desolvated analyte ions produced in said desolvation unit to said mass spectrometer, wherein said electrospray unit includes:

a) a capillary means for introducing a liquid sample;

b) a first chamber for receiving said liquid sample, said chamber including at least a first wall in which said capillary means is situated and at least a second wall, said chamber being maintained at a pressure substantially less than atmospheric pressure;

c) a means for maintaining a high electric potential difference between said liquid sample within the capillary means and said second wall, whereby the surface of said liquid sample is distorted at the outlet of said capillary means into a single electrospray cone-jet;

d) a heating means for heating the liquid sample within the capillary means to prevent the freezing of electrospray cone-jet exiting said outlet of capillary means; and e) an aperture disposed in said second wall of said first chamber so that the liquid jet and any resulting highly charged droplets from the breakup of the liquid jet are emitted from said first chamber;

and wherein said desolvation unit includes:

f) a second chamber adjacent to said first chamber maintained at a pressure substantially less than atmospheric pressure and at a higher pressure than that of said first chamber, said second chamber includes said second wall of said first chamber, said aperture through which sample is emitted; and in which said liquid sample and analyte evaporate into a gas phase so that the analyte may be received by a detection device; and g) a heating means for heating said second chamber to facilitate the evaporation of said highly charged droplets.

2. The apparatus of claim 1 wherein the pressure of said first chamber is below the threshold for the initiation of a gas discharge.

3. The apparatus of claim 1 wherein the capillary means is selectively movable with respect to said second wall.

4. The apparatus of claim 1 wherein the steering means is selectively movable with respect to said capillary means.

5. The apparatus of claim 4 wherein said steering means is electrical or electromagnetic.

6. The apparatus of claim 1, further including means of adjusting the pressure of said second chamber by controlling the quantity and flow of input gas to maintain a pressure greater than the pressure of said first chamber but substantially below atmospheric pressure.

7. The apparatus of claim 6 wherein the pressure of said second chamber is between 0.1 and 10 torr.

8. The apparatus of claim 1 wherein said analyte are ions in said liquid sample.

9. The apparatus of claim 1 wherein said analyte are neutral molecules in said liquid sample.

10. The apparatus of claim 9, further including means for ionizing said neutral molecules in the gas phase by means of a high voltage discharge.

11. The apparatus of claim 1, further including means for reacting analytes in the gas phase in said second chamber with reactants to generate ionic species.

12. The apparatus of claim 11 wherein said ions are subsequently subjected to pressure reduction, focussing, trapping or ion accelerating operation prior to the mass spectral analysis of an ion beam so generated.

13. The apparatus of claim 11 wherein said ions are subsequently subjected to focussing, trapping or ion accelerating operation prior to ion mobility analysis of an ion beam so generated.

14. An apparatus for producing desolvated analyte ions for a mass spectrometer, the apparatus comprising:

an electrospray unit receiving a liquid sample comprising analyte and discharging said analyte as a cone-jet, said electrospray unit comprising an electrospray unit housing defining a pressure region below atmospheric pressure and a desolvation unit receiving said cone-jet and outputting desolvated analyte ions produced in said desolvation unit to said mass spectrometer, wherein said electrospray unit includes:

a) a capillary means for introducing a liquid sample;

b) a first chamber for receiving said liquid sample, said chamber includes at least a first wall in which said capillary means is situated and at least a second wall, said chamber is maintained at a pressure substantially less than atmospheric pressure;

c) a means for maintaining a high electric potential difference between said liquid sample within the capillary means and said second wall, whereby the surface of said liquid sample is distorted at the outlet of said capillary means into a single electrospray cone-jet; and d) an aperture disposed in said second wall of said first chamber so that the liquid jet and any resulting highly charged droplets from the breakup of the liquid jet are emitted from said first chamber;

and wherein said desolvation unit includes:

e) a heated second chamber adjacent to said first chamber, maintained at a pressure substantially less than atmospheric pressure and at a higher pressure than that of said first chamber, said second chamber including said second wall of said first chamber, said aperture through which sample is emitted; and in which said solvent and ions evaporate into a gas phase; and f) a means of positioning the capillary means in proximity to said heated second chamber to prevent the freezing of the liquid cone-jet formed at the outlet of the capillary means.

15. The apparatus of claim 14 wherein the pressure of said first chamber is less than 0.01 torr.

16. The apparatus of claim 14 wherein the capillary means is selectively movable with respect to said second wall.

17. The apparatus of claim 14 wherein the pressure of said second chamber is between 0.1 and 10 torr.

18. The apparatus of claim 17 wherein the pressure of said second chamber is about 1 torr.

19. The apparatus of claim 14, further including a gas supply means for inputting a gas into said second chamber.

20. The apparatus of claim 19 wherein said gas is helium.

21. The apparatus of claim 14, further including a valve means for controlling the input and output gas to maintain a higher pressure in said second chamber greater than that of said first chamber but substantially below atmospheric pressure.

* * * * *